United States Patent [19]

Piepers et al.

[11] Patent Number: 4,515,670

[45] Date of Patent: May 7, 1985

[54] DEVICE FOR GALVANICALLY APPLYING A METAL COATING

[75] Inventors: Harry C. Piepers, Eindhoven; Gerard J. van Poele, Drunen, both of Netherlands

[73] Assignee: Meco Equipment Engineers, B.V., Netherlands

[21] Appl. No.: 582,993

[22] Filed: Feb. 24, 1984

[51] Int. Cl.[3] ..... C25D 17/28; C25D 17/06

[52] U.S. Cl. ..... 204/199; 204/224 R; 204/297 R

[58] Field of Search ..... 204/224 R, 297 R, 199, 204/201

[56] References Cited

U.S. PATENT DOCUMENTS 4,032,422 6/1977 Ross et al. ..... 204/224 R 4,045,321 8/1977 Bernardi et al. ..... 204/224 R X

*Primary Examiner*—Donald R. Valentine

*Attorney, Agent, or Firm*—Nilsson, Robbins, Dalgarn, Berliner, Carson & Wurst

[57] ABSTRACT

A device for galvanically applying a coating of metal, particularly precious metal to separate objects whereby that the device comprises a wheel-shaped member adapted to rotate about a rotary axis and coupled with a driving source, at least one holder fastened to the wheel-shaped member and provided with means for supporting the objects, at least one reservoir arranged below the wheel-shaped member and having at least one opening on its top side and being in sealing relationship at least around said opening with the underside of the wheel-shaped member and means for supplying pressurized electrolyte to the reservoir, while the wheel and the holder(s) have passages for guiding electrolyte from the reservoir to the objects supported by the holder(s).

15 Claims, 22 Drawing Figures

DEVICE FOR GALVANICALLY APPLYING A METAL COATING

The invention relates to a device for galvanically applying a coating of metal, particularly precious metal to separate objects.

In the electrotechnical and electronic industry there are frequently used objects such as plug sockets or the like which have to be locally provided with a coating of precious metal. For reasons of costs it is desirable to apply these coatings with utmost accuracy so that on the one hand, for example, the desired, satisfactory contact properties or the like are obtained and on the other hand the amount of coating material used should be minimized by preventing the application of the expensive material to places where it is not absolutely required.

Besides it is desirable to ensure a continuous passage of the objects to be coated through the device processing the objects in order to enable effective and economic manufacture.

According to the invention this can be achieved by providing the device with a wheel-shaped member adapted to rotate about a rotary axis, which is coupled with a driving member of at least one holder fastened to the wheel-shaped member and provided with means for supporting the objects, with at least one reservoir arranged below the wheel-shaped member and having at least one opening on its top side and being in sealing relationship around said opening with the underside of the wheel-shaped member and with means for feeding electrolyte by pressure to the reservoir, whilst the wheel and the holder(s) have passages for guiding the electrolyte from the reservoir towards the objects supported by the holder(s).

The construction embodying the invention enables to continuously supply the objects to be processed to the holders arranged at the wheel-shaped member during operation and to arrange them in the holders in a manner such that the electrolyte fed through the passages just comes into contact with those parts of the objects which have to be provided with a metal coating, whilst the electrolyte fed by pressure and hence always fresh will ensure a fast and effective coating.

The invention will be described more fully hereinafter with reference to a few embodiments schematically shown in the accompanying drawings for the construction in accordance with the invention.

FIGS. 1A and B are partly an elevational view and partly a sectional view of an embodiment of a device in accordance with the invention.

Figure 1A:
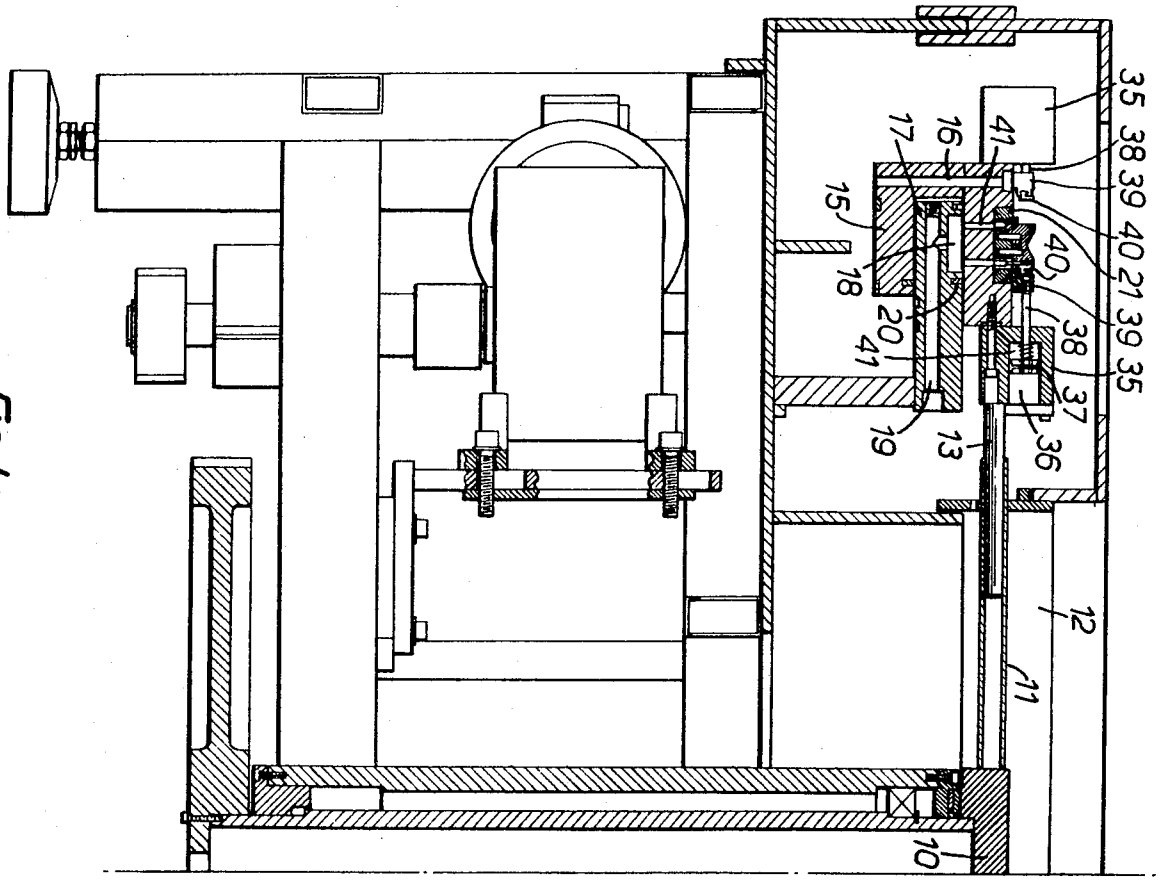
Figure 1B:
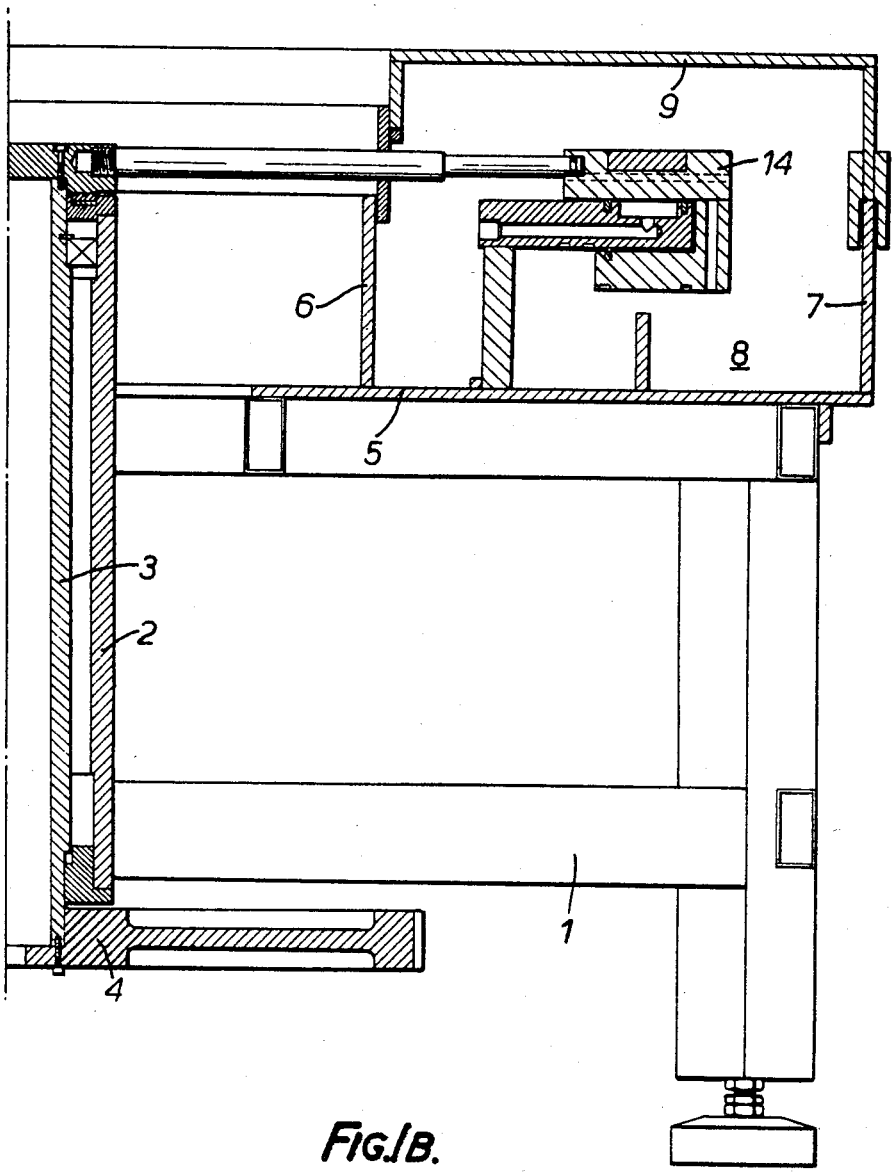

The device shown in FIG. 1 comprises a frame 1 in which a vertical hollow sleeve 2 is fastened. In the sleeve 2 is journalled a vertical hollow shaft 3. To the lower end of the shaft 3 is fastened a gear wheel 4 by means of which the shaft 3 can be rotated with the aid of a driving source, for example, an electric motor (not shown) during operation.

The frame furthermore supports a horizontal, annular plate 5. The plate 5 is provided with a vertical, annular plate 6 concentrical with the centre line of the shaft 3 and with an annular plate 7 surrounding said annular plate 6 so that these two annular plates constitute an electrolyte collecting tray concentrical with the centre line of the shaft 3.

The collecting tray 8 is covered by means of a removable cover 9.

To the top end of the shaft 3 is fastened an annular disc 10.

With the annular disc are connected a plurality of radially extending, hollow tubes 11, which extend through holes in a supporting ring 12 concentrical with the centre line of the shaft 3. The ends remote from the disc 10 hold the ends of coupling rods 13. By their ends remote from the disc these coupling rods 13 are connected with a ring 14 concentrical with the centre line of the shaft 3, which ring together with the shaft 3 and the members connecting the ring 14 with the shaft 3 constitutes a wheel-shaped member.

To the underside of the ring 14 is fastened an L-section supporting member 15 concentrical with the centre line of the shaft 3 with the aid of bolts 16.

Between the top side of the horizontal limb of the L-shaped supporting member 15 and the underside of the ring 14 one or more reservoirs 17 are extending concentrically with the centre line of the shaft 3. These reservoirs 17 comprise chambers 18 to which, during operation, pressurized electrolyte can be supplied through feeding channels 19 and ducts (not shown). Sealing members 20 establish a seal between the underside of the ring 14 and the top side of the reservoirs around the outlet ports of the chambers.

On the top side the ring 14 has an annular recess in which one or more filling pieces 21 are arranged so that the top side of such a filling piece is coplanar with the top side of the ring 14. The filling pieces have recesses holding filling bodies 22. The filling bodies 22 have on their underside open bores 23, the centre lines of which are parallel to the rotary axis of the wheel-shaped member formed by the centre line of the shaft 3.

Wear their top ends the bores 23 open out in bores of smaller diameter in the filling bodies in which small tubes 24 are arranged.

Figure 2:
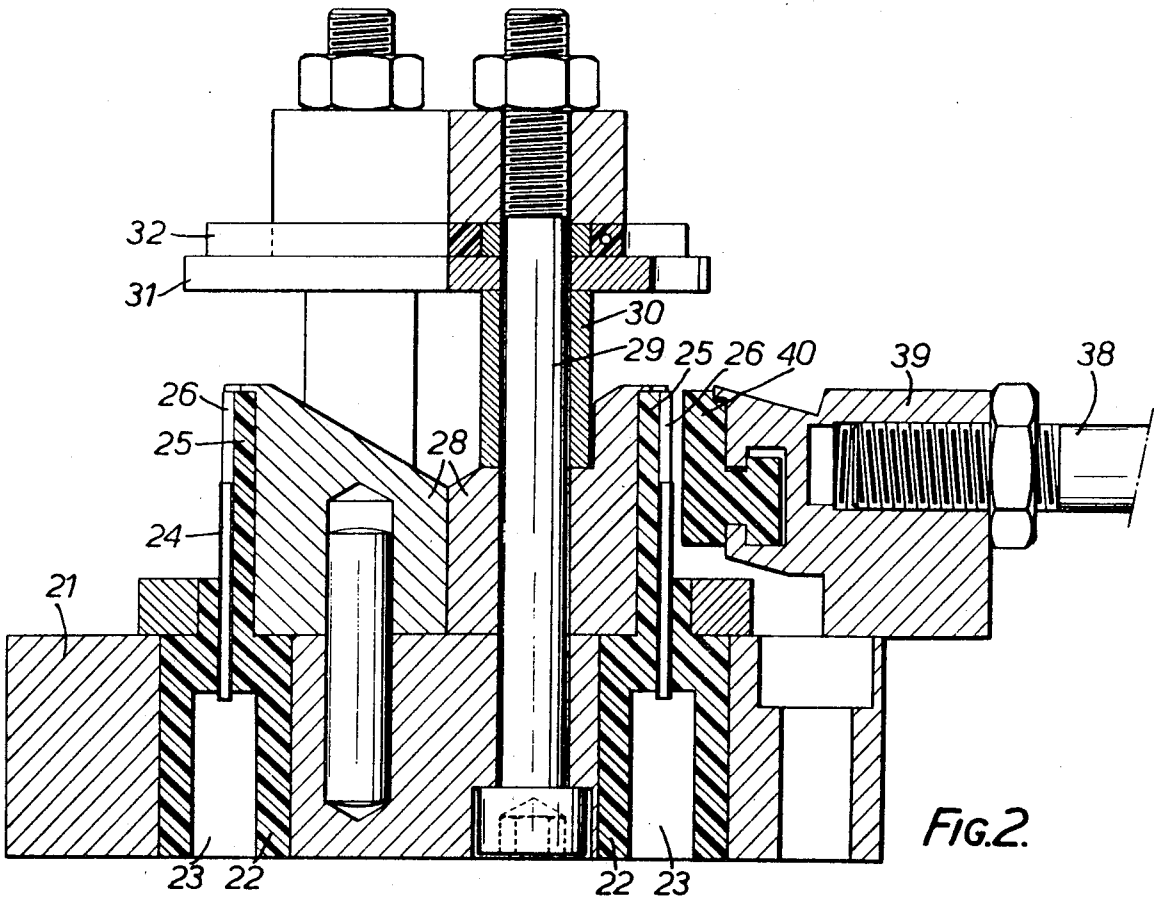
FIG. 2 shows on an enlarged scale part of the device shown in FIG. 1.
Figure 3:
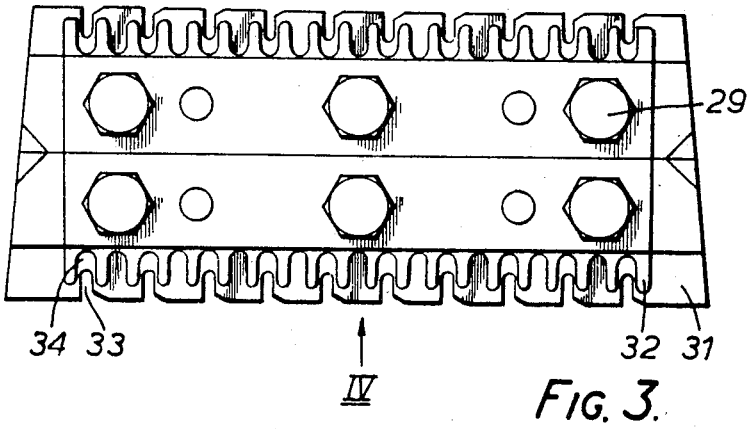
FIG. 3 is a plan view of an embodiment of a holder for picking up objects to be worked.
Figure 4:
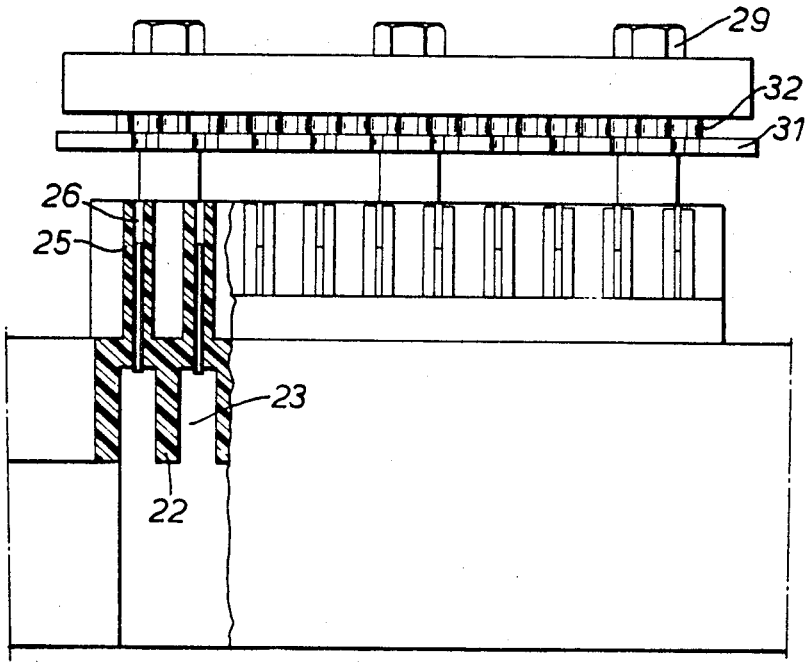
FIG. 4 is partly a sectional view and partly an elevational view in the direction of the arrow IV in FIG. 3.

The top ends of these tubes 24 are supported by upwardly extending prolongations 25 of the filling bodies, which prolongations have recesses 26 for receiving the top ends of the tubes 24. From FIG. 2 in particular it will be apparent that two of such filling bodies are arranged at different distances from the rotary axis of the wheel-shaped member. The design is such that the recesses 26 in the prolongations 26 of the filling body furthest remote from the rotary axis are open in a direction away from the rotary axis, whereas the corresponding recesses 26 in the filling body nearest the rotary axis are open towards the side of the rotary axis.

The parts of the filling bodies located at different distances from the rotary axis, which parts project above the ring 14, are supported by supporting blocks 28 arranged between said projecting parts and fastened by means of bolts 29 to the filling piece 21. The bolts 29 are surrounded by sleeves 30 bearing on the blocks 28 and by supporting plates 31 and 32 bearing on said sleeves 30.

In the embodiment shown each filling body 22 has ten bores 23 and the associated prolongations 25, the centre lines of said bores being located in a straight plane.

The edges of the holes 31 and 32 have slot-shaped recesses 33 and 34 located in line with the recesses 26.

It will be obvious that a number of such holders formed by the parts 21 to 32 intended to receive the objects to be worked can be disposed on the annular member in a circular row around the rotary axis of the wheel-shaped member.

At the level of each of these holders 22 to 32, on both sides thereof a cylinder housing 35 is fastened to the ring 14, the housing having a cylindrical space 36 in which a piston 37 is adapted to reciprocate. A piston rod 38 fastened to the piston extends through a wall of the cylinder housing 35 in the direction towards the associated holder 22 to 32. The free end of the piston rod 38 has fastened to it a supporting block 39, which supports a cushion 40 of slightly flexible material. From FIG. 2 it will be apparent that this cushion is located opposite the upwardly extending prolongations 25 of the filling body 22. With the aid of the setting cylinder formed by the cylinder housing 35 and the piston 37 this cushion 40 can be pressed against the projecting parts 25 by suppling pressurized air through a duct (not shown) to the cylinder space 36.

When the pressure fails out the cushion or masking member of the holder 22 to 32 will be withdrawn with the aid of a compression spring 41 surrounding the piston rod 38 in the setting cylinder.

The device described above operates as follows:

In operation the wheel-shaped member comprising the parts 3, 10, 12, 14 is rotated and by means of feeding means (not shown) hollow sleeves to be internally provided with a metal coating are supplied to the device at a place where the cushions 40 are withdrawn from the projecting parts 25. These hollow sleeves are arranged in the recesses 26 of the projecting parts 25 of slightly resilient material in a manner such that the open lower ends of these sleeves are in contact with the top ends of the tubes 24. The top parts of the objects are supported in the slot-shaped recesses 33 and 34 in the plates 31 and 32.

After by the further turn of the wheel-shaped member a holder has left the loading station the cushions 40 are urged by means of the setting cylinders against the sides of the holder so that the objects are completely screened on the outer circumference.

Then by a further turn of the wheel-shaped member the passages 23 get into open communication through the bores 41 in the ring 14 with a reservoir 18, from which pressurized electrolyte can flow into the interior of the hollow objects. Preferably the hollow object has a bore across its wall opening out above the cushion 40 so that electrolyte can flow away through the hollow object and can be collected in the tray 8.

Of course, anodes (not shown) are provided to enable with cathodes, for example, the tubes 24 a precipitation of the metal from the electrolyte on the object.

After a further turn of the wheel the holder again gets into an unloading station in which the objects are removed from the holders. This unloading station may at least substantially coincide with the loading station. Before reaching the unloading station the cushions 40 will again be withdrawn by means of the setting cylinder from the holder concerned.

It will be obvious that by using a device embodying the invention objects can be continuously locally covered with a metal coating, particularly consisting of precious metal.

Moreover the device can not only be used for internally coating hollow objects but also for processing differently shaped objects by a slight modification.

Figure 5:
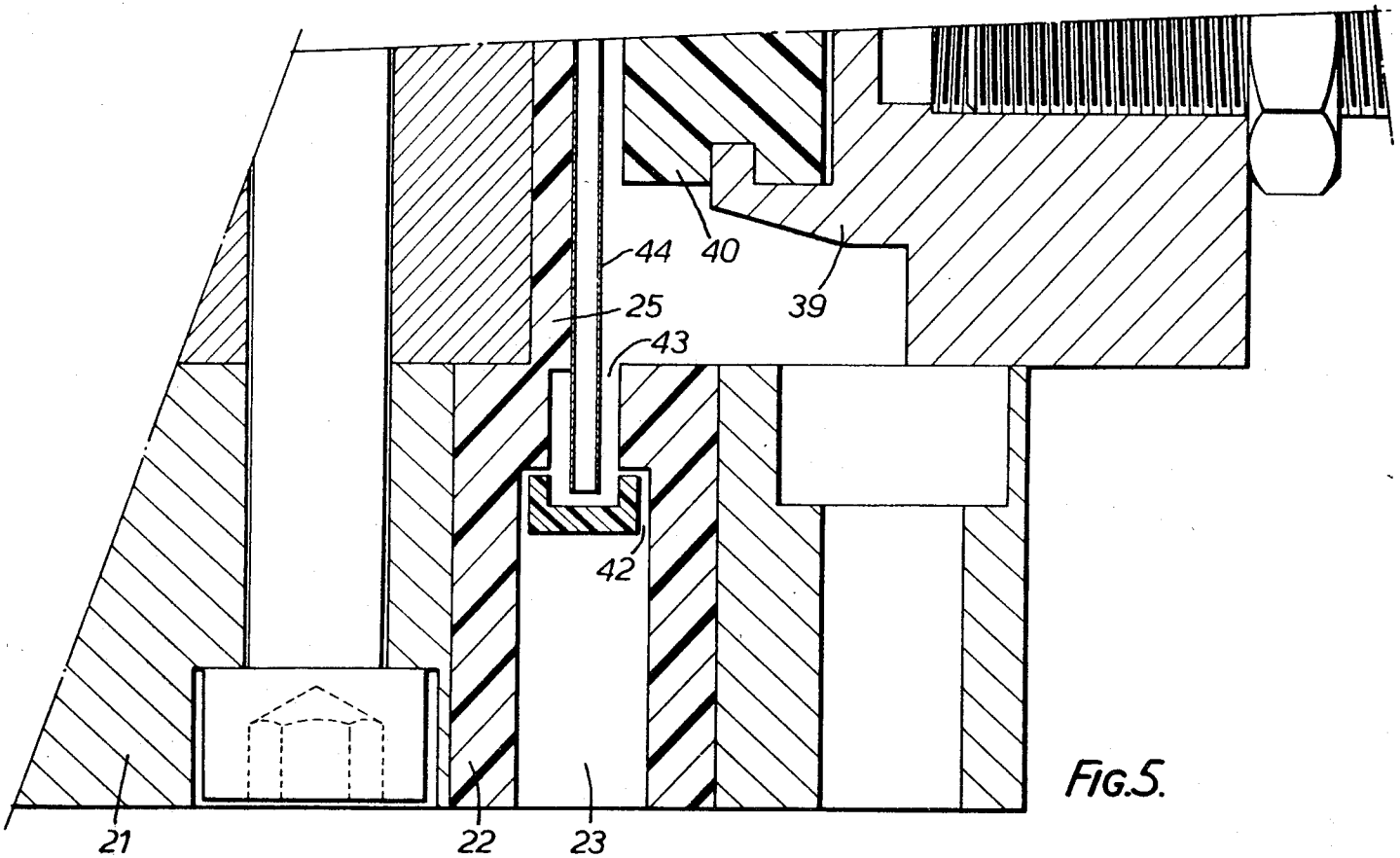
FIG. 5 is a schematic sectional view of part of a second embodiment of a holder in accordance with the invention.

FIG. 5 shows an embodiment with a slightly different filling body 22, the bore 23 communicating through bores 42 in the filling body with a chamber 43 in the filling body in the lower end of the projecting part 25. FIG. 5 shows that elongate objects 44, which may be formed by hollow or solid pins or the like can be disposed in the recesses 26 in a manner such that the lower ends of said objects 44 project into the chambers 43. As a result, in operation the electrolyte will be sprayed through the passage 42 against these lower ends of the objects.

Figure 6:
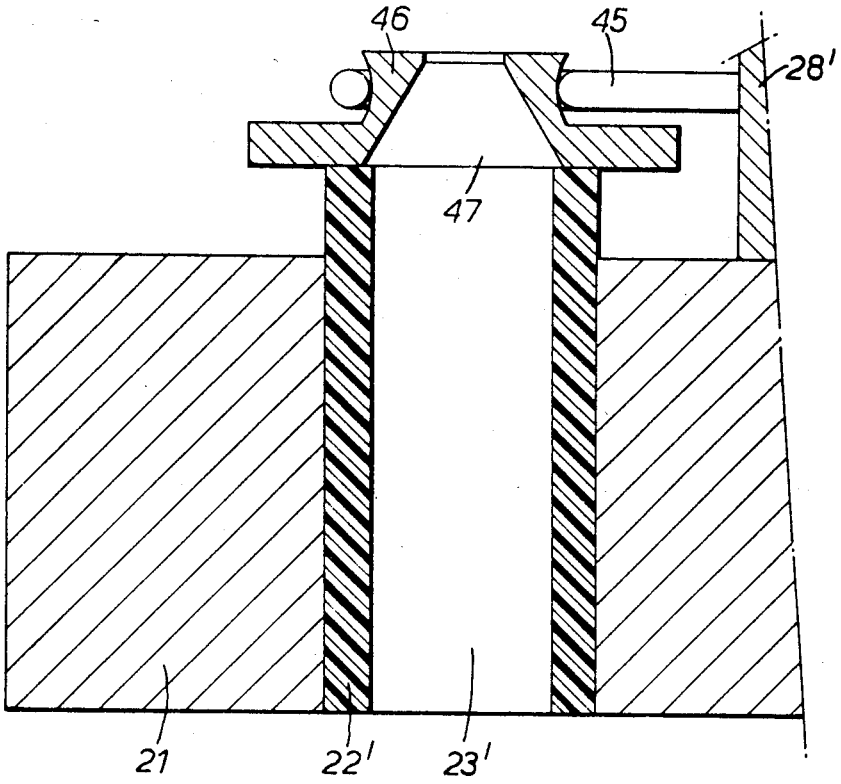
FIG. 6 is a schematic sectional view of a third embodiment of a holder for use in the device embodying the invention.

In the embodiment shown in FIG. 6 the filling pieces 21 are provided with filling bodies 22' projecting above the filling pieces 21 and having bores 23' extending along the entire height of said filling bodies. Supporting blocks 28' rather than the supporting blocks 28 receive the ends of curved brackets 45 of spring steel projecting to the outer side and to the inner side respectively of the wheel, which brackets can pairwise receive discs 46 in a manner such that passages in these discs get on the top sides of the filling bodies 22'. Obviously in this embodiment the pressurized electrolyte can be sprayed through the passage 47 to cover the boundary surface of said passage with a metal coating.

Figure 7:
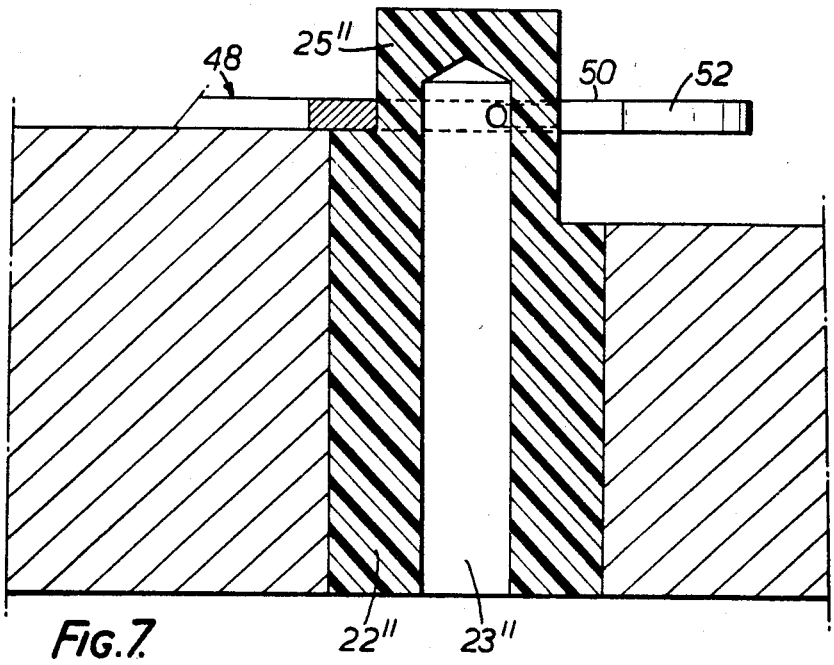
FIG. 7 is a schematic sectional view of a further embodiment of a holder suitable for use in a device in accordance with the invention.
Figure 8:
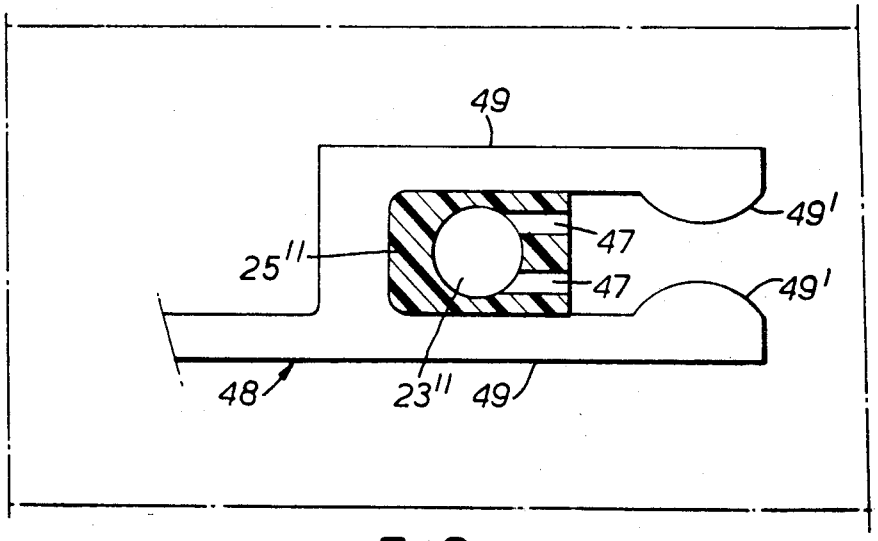
FIG. 8 is partly a plan view and partly a sectional view of the holder shown in FIG. 7.

FIGS. 7 and 8 show an embodiment in which the filling pieces comprise filling bodies 22'' having upwardly extending bores 23'' opening out at the top ends in a projecting part 25'' having an at least substantially rectangular cross-section. The bore 23'' is in open communication with two horizontal bores 47 opening out in the outer side of the projecting part 25".

As is shown in FIGS. 7 and 8 an object 48 can be arranged so that two relatively parallel limbs 49 of this object extend one on each side of the projecting part 25". It is apparent from FIG. 8 that the disposition is such that projecting parts 49' on the proximal sides of the limbs 49 will be struck during operation by electrolyte jets emanating from the bores 47 so that these projecting parts 49' will be provided with a metal coating.

Although in the foregoing reference is made to the supply of electrolyte through the chambers 18 in the reservoirs 17, it will be obvious that as an alternative reservoirs arranged below the wheel-shaped member may be used for the supply of pressurized washing and flushing fluid.

Figure 9:
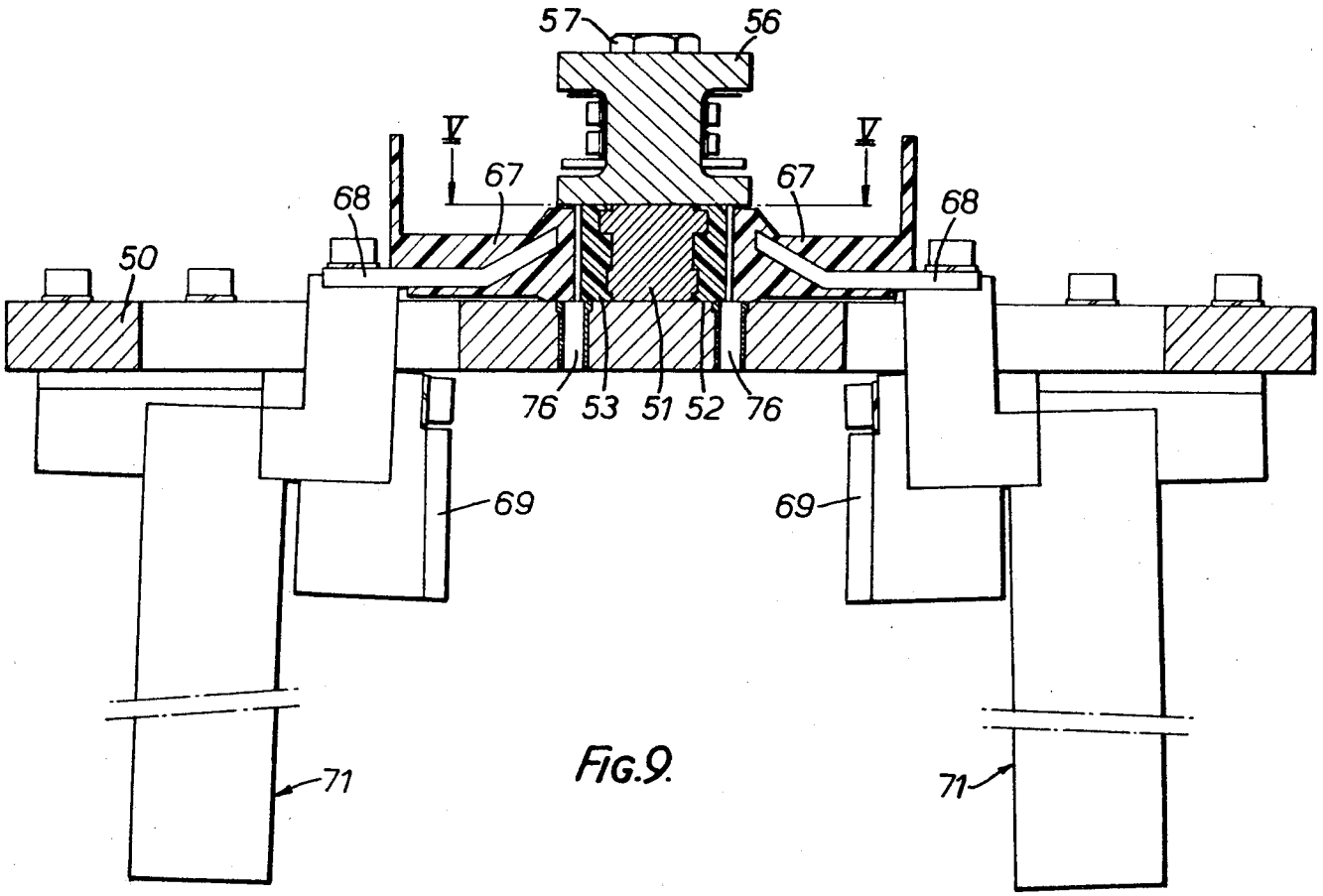
FIG. 9 shows part of a second embodiment of a device in accordance with the invention partly in an elevational view and partly in a sectional view.
Figure 10:
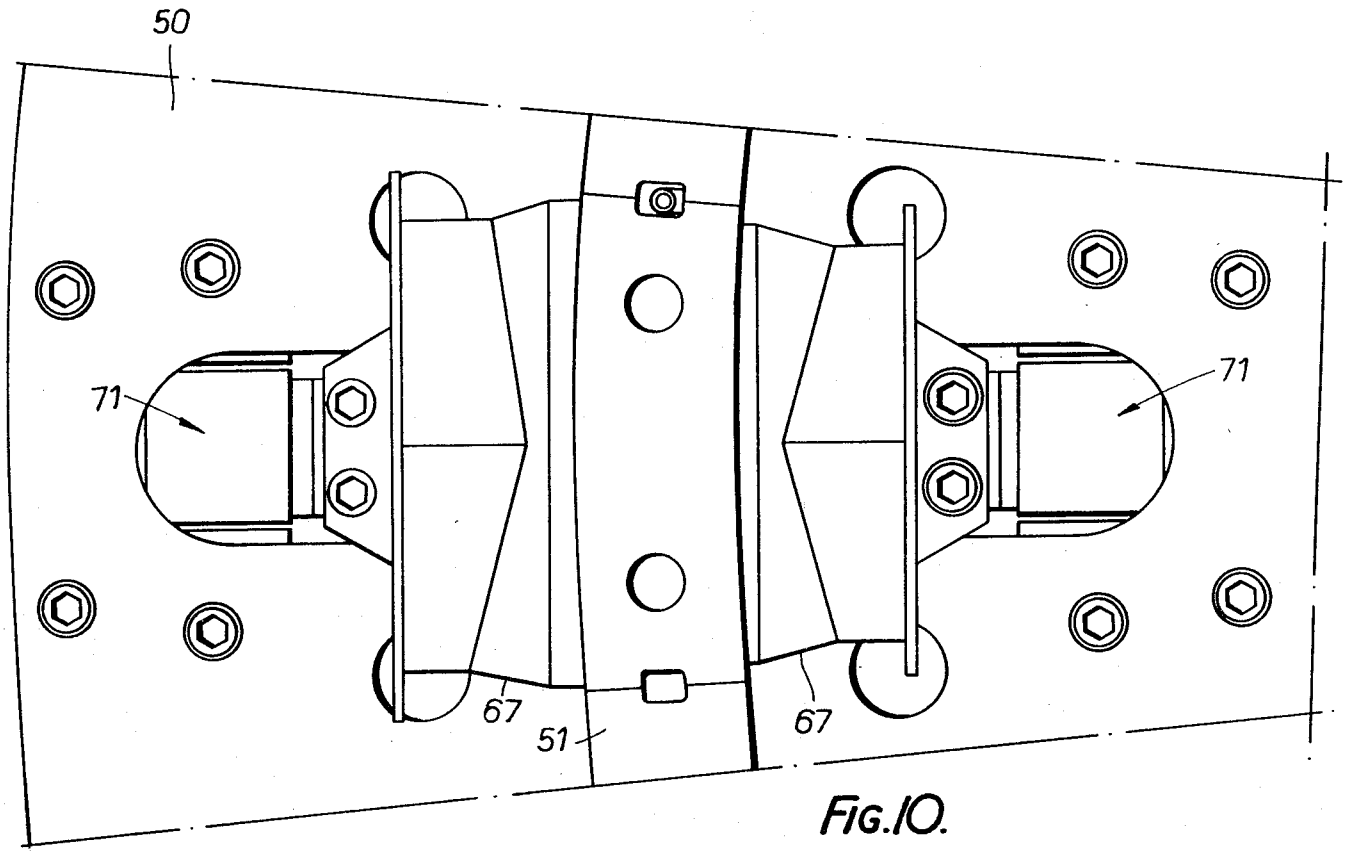
FIG. 10 is a plan view of part of the device of FIG. 9.

FIG. 9 is a sectional view of an outer rim part of a wheel-shaped plate 50 of a further embodiment of a device in accordance with the invention, in which during operation said wheel-shaped plate can be rotated with the aid of a driving source (not shown) about a rotary axis normal to said plate.

The plate supports an annular member 51 preferably formed by segments forming holders and being coated on the inner and outer circumference by covering layers 52 and 53 respectively of flexible material. These layers have grooves 54 and 55 spaced apart by equal distances, viewed in a circumferential direction, and being parallel to the rotary axis of the wheel-shaped member comprising the disc 50 and the annular member 51 fastened thereto.

The annular member supports an annular member 56 also formed by segments and having an at least substantially H-shaped section. The annular members 51 and 56 disposed one on the other are fixed to the wheel-shaped disc 50 by means of bolts 57 passed through said members.

Figure 12:
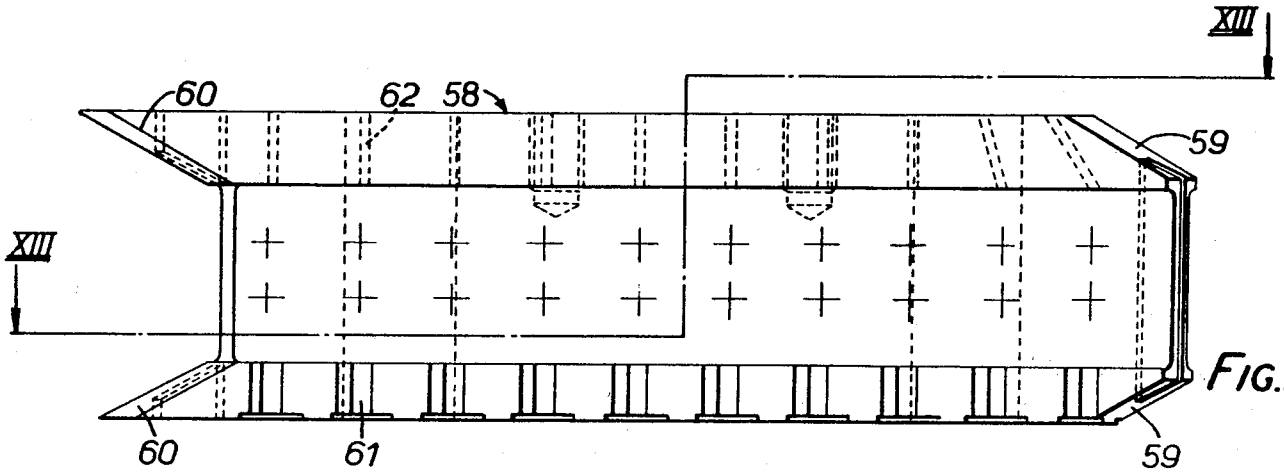
FIG. 12 is a side elevation of a holder used in the device shown in FIG. 4.
Figure 13:
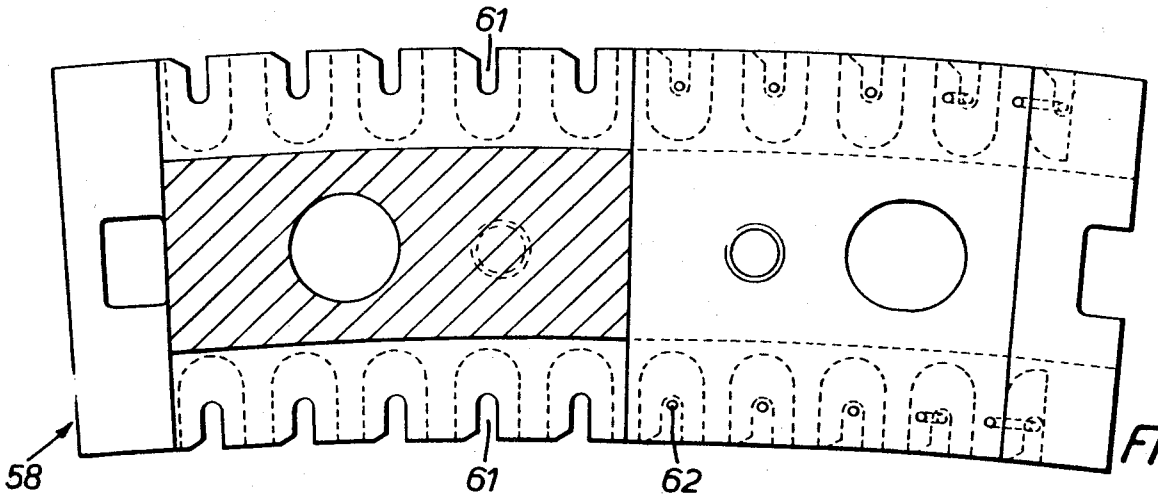
FIG. 13 is a sectional view and an elevational view of FIG. 12 taken on the line XIII—XIII in FIG. 12.

The annular member 56 comprises segments 58, one of which is shown in FIGS. 12 and 13 partly in a plan view and partly in a sectional view.

From FIG. 12 it will be apparent that a segment is bevelled at one end to form inclined faces 59, whereas the other end is provided with complementary noses 60 so that when joining successive segments to form the annular member 56 the extensions 60 of one segment 58 grip around the bevelled ends 59 of the neighbouring segment 58.

The lower limbs of the H-shaped profile, near the inner side of the annular member as well as near the outer side thereof, have radially extending elongate holes 61, which are open on the outer side and, respectively, on the inner side of the profile. The upper horizontal limbs of the annular member 56 have bores 62 receiving pins 63. Each pin 63 is fastened to a U-shaped bracket 64 located between the horizontal limbs of the annular member 56 and fastened to said annular member by means of bolts 65. The lower limb of each bracket 64 is formed by a fork for receiving an upper end of an elongate product 66 to be worked. Obviously such a bracket 64 is arranged at each elongate hole 61 both on the inner and on the outer circumference of the annular member 56.

On both sides of each segment 58 of the annular member 51 masking members 67 are arranged to co-operate with the segment. The masking members are made from slightly resilient material and fastened to carrying plates 68 partly embedded in said masking members.

Figure 16:
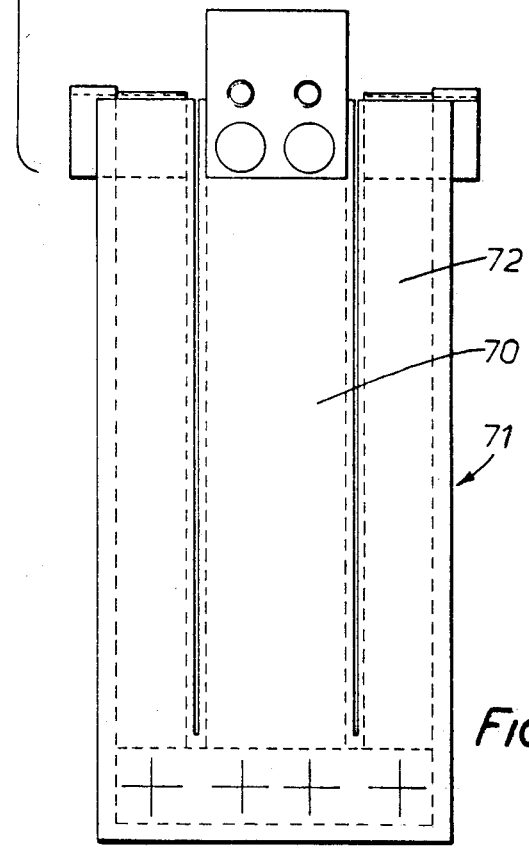
FIG. 16 is an elevational view of a spring member for supporting a masking member.

The part of each carrying plate 68 projecting out of a masking member, together with a guide lug 69 located on the masking member concerned, is fastened to a central arm 70 of a spring packet (FIG. 16). This central arm 70, which may be made from a plurality of relatively parallel blade springs is fastened by its lower end to the lower ends of arms 72 located one on each side of said central arm 70 and preferably formed likewise by a plurality of relatively parallel blade springs, the top ends of said arms being fastened to the plate 50.

In the position of the masking members shown in FIG. 9 these masking members are firmly urged by the spring packet against the inner and, respectively, the outer circumference of the annular member 51, whilst the parts of the masking members lying near the annular member are furthermore pressed against the top side of the plate 50.

Figure 14:
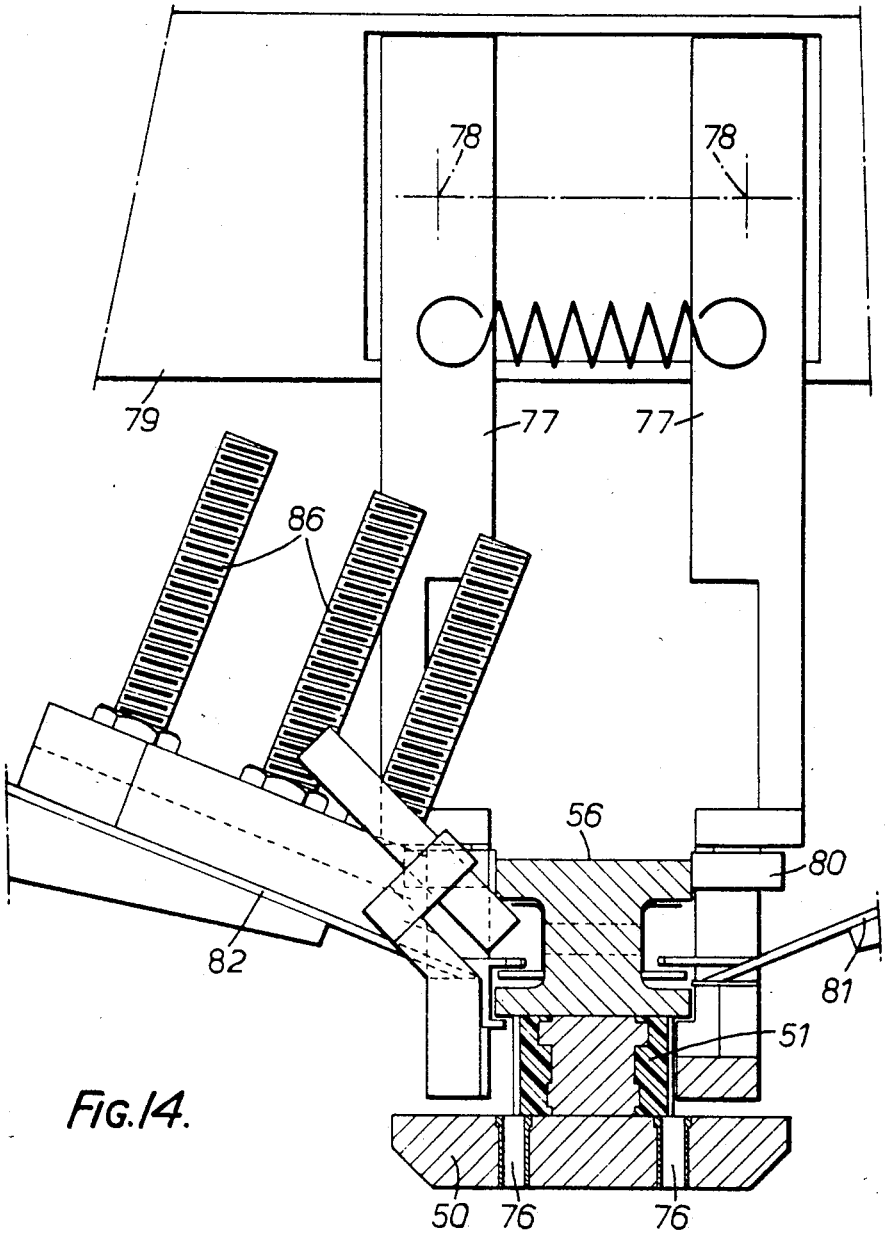
FIG. 14 is partly a sectional view and partly an elevational view of an embodiment of a feeding mechanism for supplying products.
Figure 15:
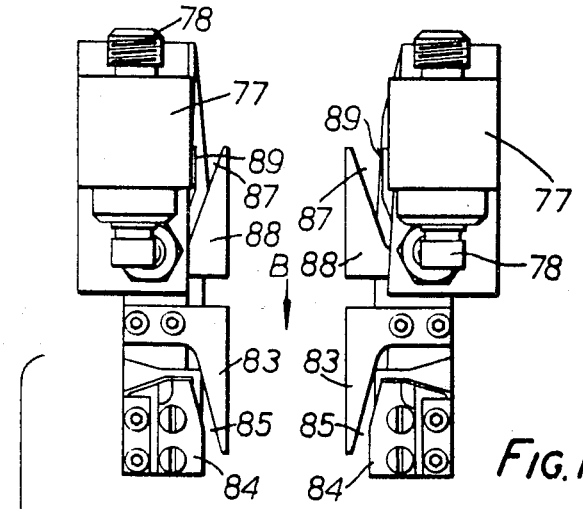
FIG. 15 is a plan view of part of the supply and delivery mechanism for the products.

At a given point of the path of movement of the annular members 51 and 56 rotating about the rotary axis in operation is arranged the mechanism shown in FIGS. 14 and 15 for the supply and evacuation of the products to be worked. At the level of this mechanism for supply and delivery of products a cam disc (not shown) is arranged below the plate 50 so that the cams 69 will co-operate with the distal boundary edges of said cam disc in order to press away from one another the cams and hence the masking members 67 on either side of the annular member 51 in a direction away from the annular member.

Figure 17:
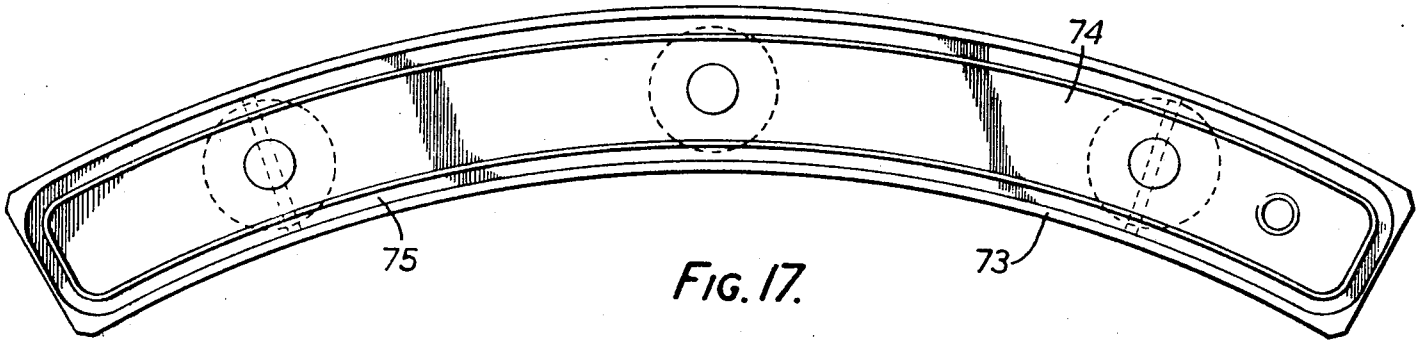
FIG. 17 is a plan view of a reservoir for the supply of pressurized electrolyte.
Figure 18:
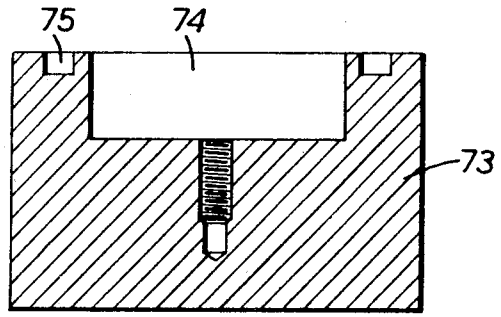
FIG. 18 is a sectional view of the reservoir of FIG. 17.

In the same manner as in the embodiment described above trays 73 curved along part of the circumference are arranged below the disc 50, which trays can be pressed against the underside of the disc 50 with the aid of spring members (not shown). The trays 73 have chambers 74 surrounded by endless grooves 75 intended to accommodate sealing members. When during operation the disc-shaped member 50 rotates, the passages provided in this disc-shaped member and extending parallel to the rotary axis of said member will communicate with the chambers 74 of the trays 73, which chambers contain, in operation, pressurized electrolyte (FIGS. 17, 18).

It will, in particular, be apparent from FIG. 9 that the passages 76 open out on the top side of the disc 50 at the level of the planes in which the masking members 67 are in contact with the inner circumference and, respectively, the outer circumference of the annular member 51.

The supply and delivery mechanism shown in FIGS. 14 and 15 for the products to be worked comprises two arms 77, which are pivotally coupled by means of horizontally pivotal shafts 78 with a stationary frame part 79 of the device. Near the lower ends of the arms 77 guide rollers 80 are adapted to rotate about upwardly extending rotary axes said rollers rolling, in operation, along the inner and, respectively, the outer circumference of the upper horizontal limbs of the annular member 56.

At the level of said supply and delivery mechanism are arranged two supply gutters 81 and 82 with the aid of which, in the manner described above, the products to be worked can be supplied in order of succession in the direction of the inner and, respectively the outer circumference of the annular member.

The facing ends of the supply gutters 81 and 82 communicate with guide channels 85 bounded by guide members 83 and 84 fastened to the lower ends of the arms 77, through which channels the supplied products are fed to the annular member 51 rotating in the direction of the arrow B between the guide members. The arrangement is such that the products to be worked, when they are located near the outlet ends of the grooves 85, are taken over in the radial recesses 61 of the annular member 56, whilst the top ends of these products 66 are urged into the fork-shaped ends of the brackets 64 and the hollow lower ends of the products 66 get into the recesses 54 and 55 respectively.

As is furthermore shown in FIG. 14 for the supply member 82 on the left-hand side of said Figure, sensors 86 can be arranged near the end of the supply member for checking the movement and the presence of a given buffer stock of parts 66 to be worked in the supply member 82. With the aid of these sensors 86 means can be actuated for ensuring the supply of the parts 66 to be worked to the supply member 81 or 82 concerned and means for stopping the device at the assessment of lack of parts 66 to be worked.

The lower ends of the arms 77 are furthermore provided with guide members 88 and 89 bounding guide grooves 87.

Into these guide grooves 87 get the top ends of the parts 66 to be worked passed around by the wheel-shaped member, the top ends of the worked parts 66 moving in front of the grooves 87. The Figure shows that the grooves extend in a direction away from the inner circumference and the outer circumference respectively of the annular member 56 so that the top ends of the parts 66 moving through the grooves 87 during rotation of the annular member 56 are displaced in a direction away from the annular member 56 so that these parts get free from the annular members 51 and 56.

Figure 19:
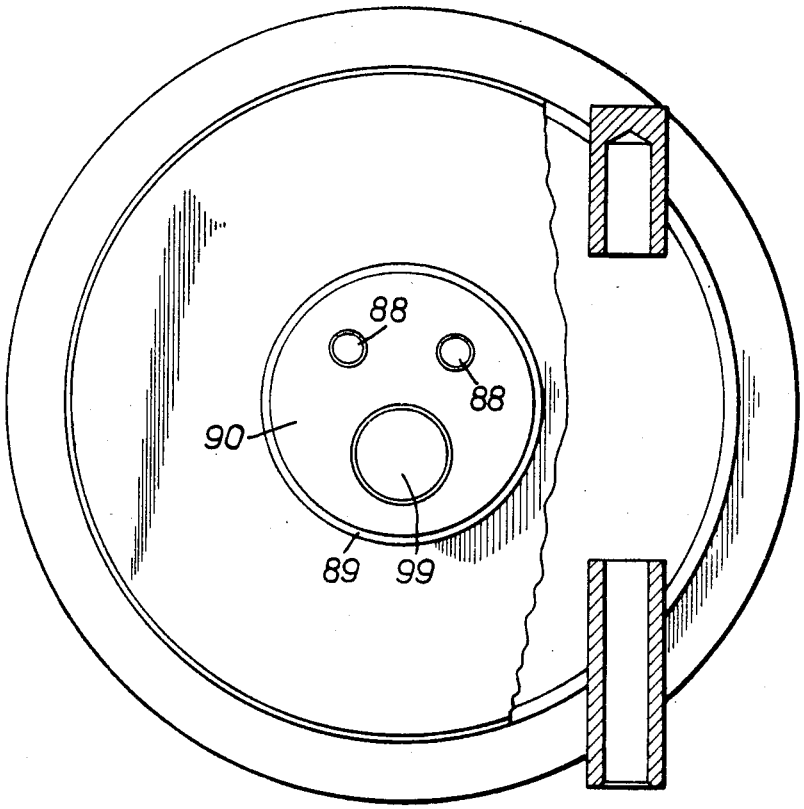
FIG. 19 shows means for picking up the processed products.
Figure 20:
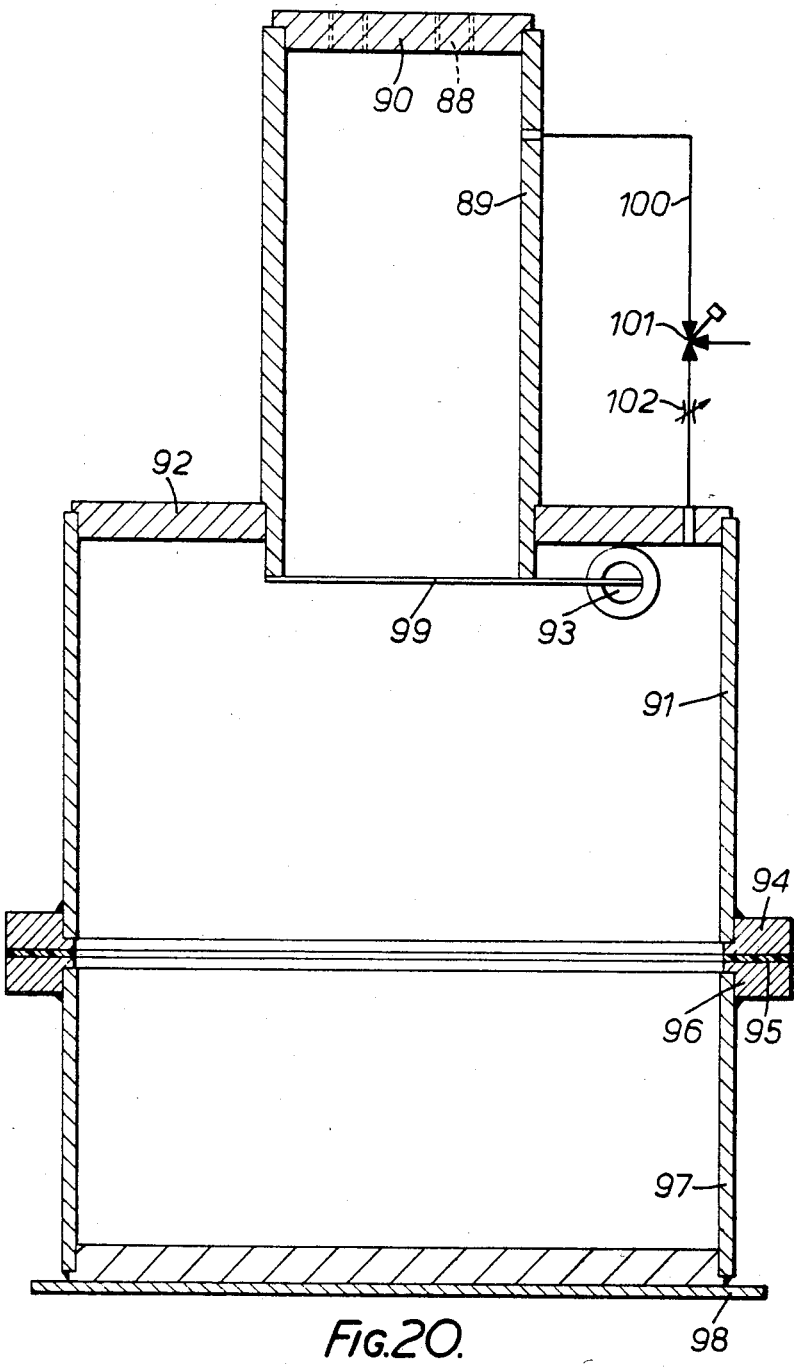
FIG. 20 is partly a plan view and partly a sectional view of the member of FIG. 19.

Near the ends of the grooves 87 remote from the annular members 51 and 56 are located the outlets of ducts (not shown) communicating with holes 88 in a cover 90 fastened to the top end of a pipe 89 (FIGS. 19 and 20). The lower end of the pipe 89 is passed through a pipe 91 of larger diameter, the top end of which is closed by a cover 92. For closing the lower end of the pipe 89 a flap plate 94 rotatable about a horizontal shaft 93 is arranged in the pipe 91.

The lower end of the pipe 93 has fastened to it a flange 94. With the interposition of a stuffing member 95 the underside of the flange 94 is in contact with a flange 96 fastened to the top end of a vessel 97. At the lower end the vessel 97 is supported by a supporting plate 98.

The cover 90 has furthermore an opening 99 for connecting an exhaust pump (not shown) with the interior of the pipe 89.

The interior of the pipe 89 communicates with the interior of the pipe 91 through a by-pass duct 100 including a three-way cock 101 and a choking member 102. With the aid of the three-way cock 101 a direct communication can be established between the interior of the pipe 89 and the interior of the pipe 91 through the choke 102, whilst a direct communication can be established between the interior of the pipe 91 and the atmosphere.

During operation the objects to be worked can be supplied through the supply gutters 81 and 82 in the direction to the guide members 83 and 84. Through the passages 85 bounded by the guide members, whose delivery ends are bent over in the direction of movement of the rotating wheel 55 the objects to be worked get into the radial recesses 61 of the annular member 56 and thus will be carried along. The top ends of the objects to be worked 66 get into the fork-shaped ends of the brackets 64 connected to a current source (not shown).

Upon further rotation of the wheel the masking members 67 moved away from one another at the level of the supply station for the objects to be worked as described above will again move towards one another so that these masking members are urged against the covering layers 52 and 53 and the lower ends of the pin-shaped objects 66 to be worked as well as against the top face of the disc 50 in order to obtain a satisfactory seal between said parts. Upon a further turn of the disc 50 the passages 76 of the disc get into communication with a chamber 74 of a tray 73 so that from this tray pressurized electrolyte can flow into the hollow lower ends of the pin-shaped objects 66 to be coated with the precious metal or the like in the same manner as described above.

The pins 66 thus worked then arrive again at the loading and unloading station where the pins are released with the aid of the guide members 88 and 89 from the annular members 51 and 56 and get at the level of the above-mentioned ducts (not shown) connected with the openings 88.

With the aid of the above-mentioned exhaust pump subatmospheric pressure is produced in the interior of the two pipes 89 and 91 and the vessel 97. The flap 94 is open and the three-way cock 101 is in a position such that the interior of the pipe 89 also communicates through the duct 100 with the interior of the pipe 91.

The objects thus sucked in will drop into the vessel 97.

When the vessel 97 has to be emptied, the flap 94 can be closed and the three-way cock 101 can be moved into a position in which the interior of the vessel 101 gets into open communication with the atmosphere through the choke 102. The pressure in the interior of the vessel 97 and the pipe 91 thus gradually increases and when the pressure in the interior of said parts is at least substantially equal to the atmospheric pressure the vessel 97 can be slipped from beneath the flange 94 to remove the worked objects from the vessel. Then the vessel 97 can be returned to its position and the three-way cock 101 can be set in a position in which a communication is re-established between the interior of the pipe 89, in which subatmospheric pressure is still prevailing, and the interior of the pipe 91. This communication is established through the choke 102 so that the subatmospheric pressure can be gradually built up in the interior of the pipe 91 and the vessel 97, after which the flap 94 can be re-opened.

Figure 11:
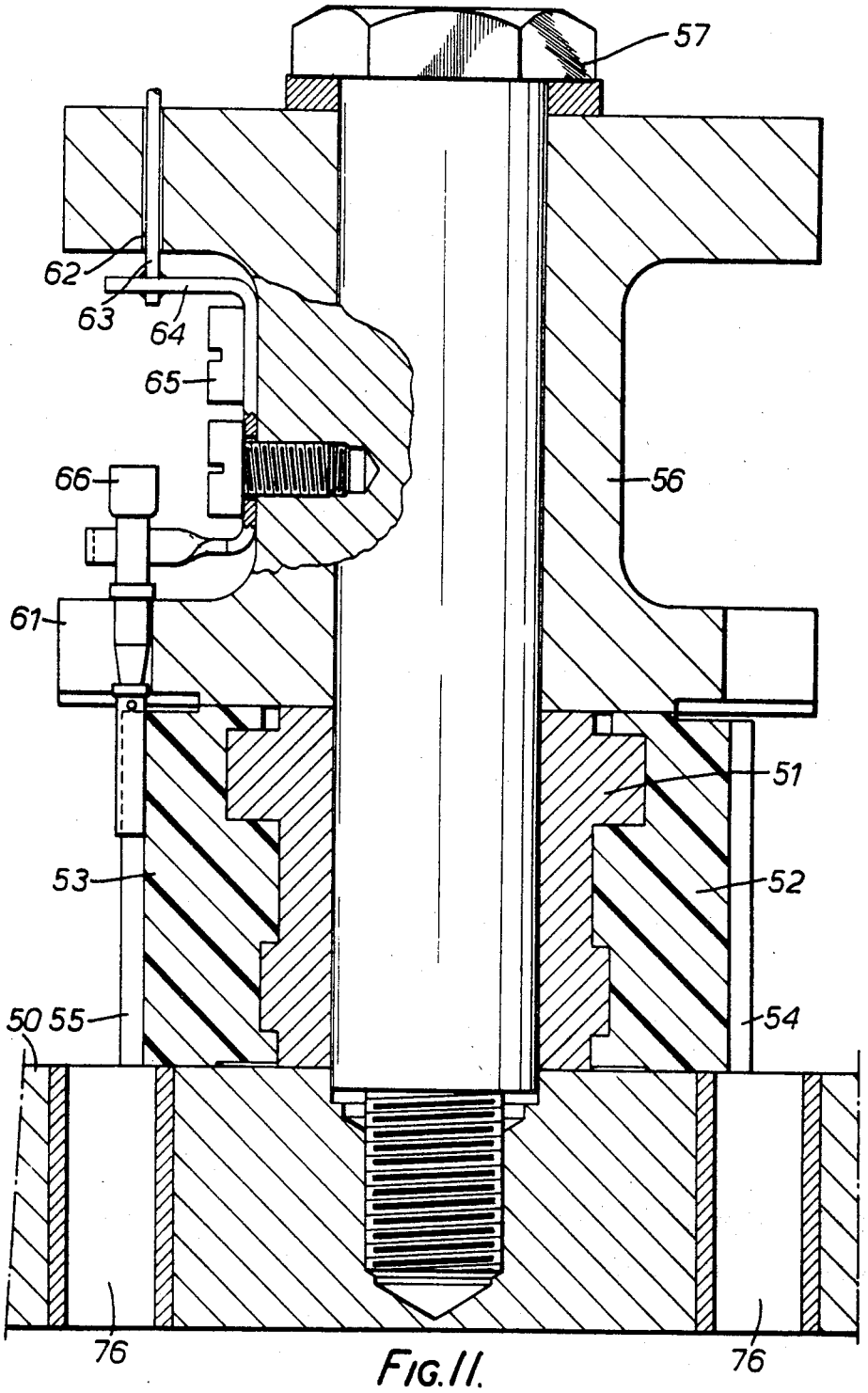
FIG. 11 shows on an enlarged scale part of FIG. 10.
Figure 21:
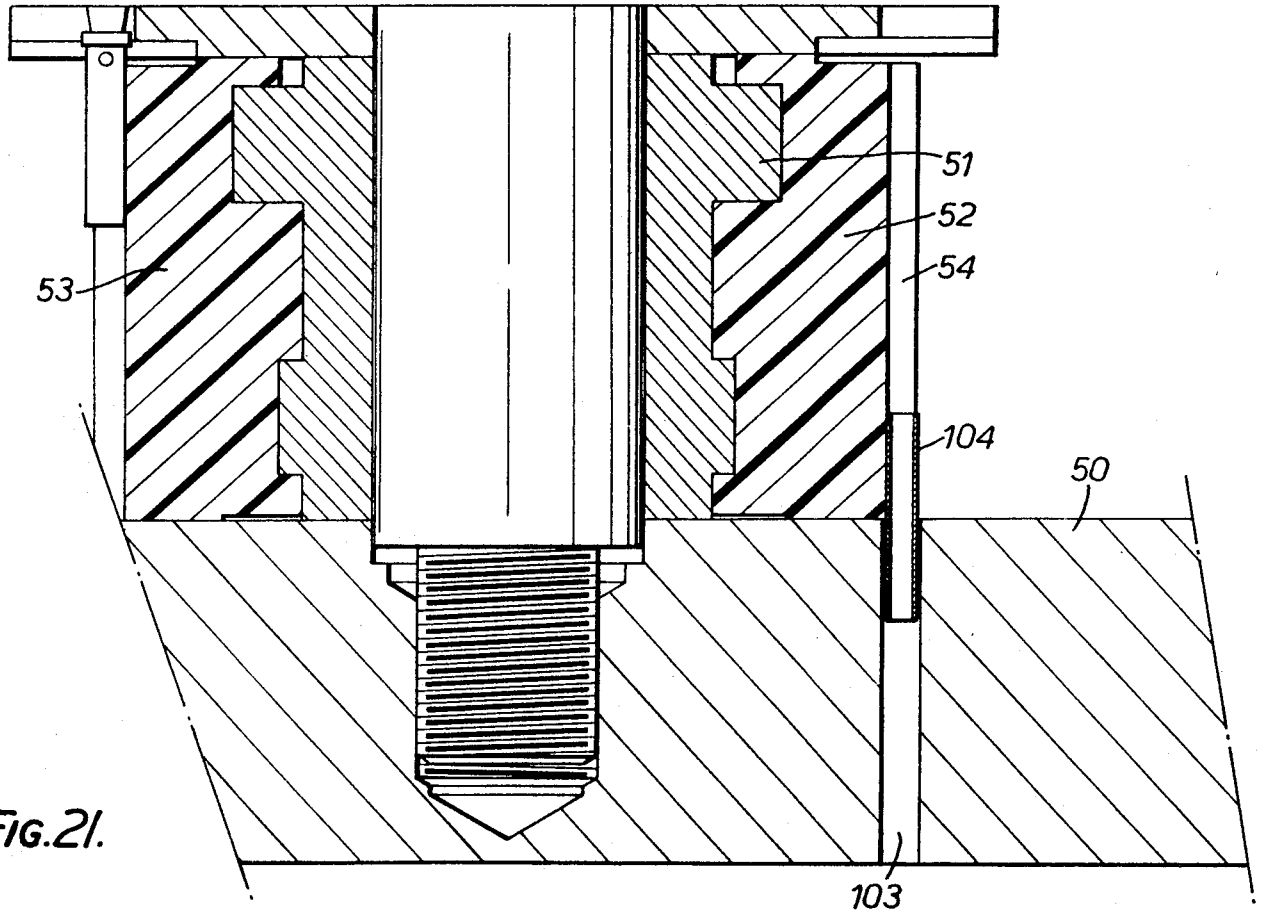
FIG. 21 is a sectional view of part of a further embodiment of a device in accordance with the invention.

FIG. 21 shows part of a modified embodiment corresponding with the part shown in FIG. 11. Corresponding parts of the two embodiments are designated by the same reference numerals. In this embodiment the passages 76 are replaced by smaller passages 103 in the wheel 50 in which are located the lower ends of upwardly extending ducts 104 of flexible material. These ducts 104 have a diameter equal to or slightly larger than the diameter of the lower ends of the pins 66 or the like to be worked. The masking members 67 are less high so that in an operational position these masking members are not in contact with the top side of the wheel 50. When the masking members are urged against the covering layers 52 and 53, not only the lower ends of the pins 66 but also the top ends of the hoses 104 are clamped tight so that around these hoses a satisfactory seal is obtained so that a seal of the masking members on the top side of the wheel 50 can be dispensed with, which simplifies the design.

What is claimed is:

1. An electroplating device for applying a coating of metal, particularly precious metal, to separate objects comprising:

(A) a wheel-shaped member;

(B) a driving source coupled to said wheel-shaped member to rotate said member about a rotary axis;

(C) a plurality of holder means arranged one behind the other and fastened to said wheel-shaped member, each of said holder means defining grooves for receiving a predetermined number of said objects arranged side by side and which further includes masking members arranged so as to be movable transversely of the rotary axis of said wheel for at least partly covering said objects received in said holder;

(D) means on said holder for supporting said objects;

(E) at least one reservoir arranged below said wheel-shaped member and having at least one opening on its top side and being in sealing relationship at least around said opening with the underside of said wheel-shaped member; and (F) means for supplying pressurized electrolyte to said reservoir, said wheel-shaped member and said holder having passages for guiding electrolyte from said reservoir to said objects supported by said holder.

2. A device as claimed in claim 1 wherein said holder defines first and second groups of recesses for receiving said objects, said first group being on a side of said holder nearest the rotary axis and said second group being on a side thereof remote from the rotary axis.

3. A device as claimed in claim 2 wherein said holder means includes a plurality of filling bodies removably disposed therein, each of said filling bodies defines passages therein for receiving said electrolyte.

4. A device as claimed in claim 3 which further includes a setting cylinder affixed to said wheel and having a reciprocatable piston and piston rod therein, means affixing said masking members to said piston rod for moving said masking members towards said holders and away from said holders.

5. A device as claimed in claim 2 which further includes a setting cylinder affixed to said wheel and having a reciprocatable piston and piston rod therein, means affixing said masking members to said piston rod for moving said masking members towards said holders and away from said holders.

6. A device as claimed in claim 2 which further includes cam means and means connecting said cam means to said masking means for transversely moving said masking means.

7. A device as claimed in claim 1 wherein said holder means includes a plurality of filling bodies removably disposed therein, each of said filling bodies defining passages therein for receiving said electrolyte.

8. A device as claimed in claim 7 which further includes a setting cylinder affixed to said wheel and having a reciprocatable piston and piston rod therein, means affixing said masking members to said piston rod for moving said masking members towards said holders and away from said holders.

9. A device as claimed in claim 1 which further includes a setting cylinder affixed to said wheel and having a reciprocatable piston and piston rod therein, means affixing said masking members to said piston rod for moving said masking members towards said holders and away from said holders.

10. A device as claimed in claim 1 which further includes cam means and means connecting said cam means to said masking means for transversely moving said masking means.

11. A device as claimed in claim 10 wherein a masking member is supported on a resilient support and said cam means cooperates therewith for reciprocating said masking member with respect to said holder means.

12. A device as claimed in claim 1 which further includes gutter means for receiving said objects and defining a delivery end; means defining a guide groove, said delivery end of said gutter means communicating with said guide groove, said guide groove being bent in the direction of rotation of said wheel-shaped member towards said holder means.

13. A device as claimed in claim 12 which further includes means for delivering the worked objects, said means having a groove extending in a direction away from said holder means on said wheel-shaped member and an exhaust duct having an opening disposed adjacent said groove.

14. A device as claimed in claim 13 wherein said exhaust duct communicates with a space that can be divided into two separate parts by means of a flap, said parts communicating with one another through a bypass duct including a three-way cock and a choking member so that through the three-way cock and the choking member a direct communication between the two parts of the vacuum space can be established and one of said parts of the vacuum space gets, in the other position of the three-way flap through the choking member and the three-way cock into open communication with the atmosphere.

15. A device as claimed in claim 1 which further includes means for delivering the worked objects, said means having a groove extending in a direction away from said holder means on said wheel-shaped member and an exhaust duct having an opening disposed adjacent said groove.

* * * * *